US009612076B2

(12) United States Patent
Griggs

(10) Patent No.: US 9,612,076 B2
(45) Date of Patent: Apr. 4, 2017

(54) BOWSTRING HAVING DIFFERENT ULTRA HIGH MOLECULAR WEIGHT POLYETHYLENE FIBERS FOR CREEP REDUCTION

(71) Applicant: Winner's Choice Custom Bowstrings, LLC, Henrietta, NY (US)

(72) Inventor: Eric J. Griggs, Stanton, KY (US)

(73) Assignee: Winner's Choice Bowstrings LLC, West Henrietta, NY (US)

( * ) Notice: Subject to any disclaimer, the term of this patent is extended or adjusted under 35 U.S.C. 154(b) by 0 days.

(21) Appl. No.: 14/807,195

(22) Filed: Jul. 23, 2015

(65) Prior Publication Data

US 2016/0025444 A1 Jan. 28, 2016

Related U.S. Application Data

(60) Provisional application No. 62/028,885, filed on Jul. 25, 2014.

(51) Int. Cl.
*F41B 5/14* (2006.01)

(52) U.S. Cl.
CPC ..... *F41B 5/1411* (2013.01)

(58) Field of Classification Search
CPC ..... F41B 5/14; F41B 5/1411
USPC ..... 124/90
See application file for complete search history.

(56) References Cited

U.S. PATENT DOCUMENTS 2,271,173 A * 1/1942 Lay ..... F41B 5/1411 124/90
2,508,521 A * 5/1950 Lay ..... F41B 5/1411 124/90
2,769,439 A * 11/1956 Layer ..... F41B 5/1411 124/90
3,714,316 A * 1/1973 Angeloff ..... F41B 5/1411 124/90
4,702,067 A * 10/1987 Izuta ..... D01F 6/04 124/90
5,598,831 A * 2/1997 Izuta ..... F41B 5/14 124/90
5,676,123 A * 10/1997 McPherson ..... F41B 5/1419 124/90
5,715,804 A * 2/1998 Izuta ..... F41B 5/14 124/90
5,752,496 A * 5/1998 McPherson ..... F41B 5/1419 124/90
5,884,617 A * 3/1999 Nelson ..... F41B 5/14 124/90

(Continued)

OTHER PUBLICATIONS

"Predicting the Creep Lifetime of HMPE Mooring Rope Applications", Vlasblom et al, On or before Dec. 31, 2006 in year 2006, 10 pages.
"Mechanical behavior of HMPE and aramid ropes for deep sea handling operations", Ocean Engineering, On or before Dec. 31, 2011 in year 2011, vol. 38 (17-18), 18 pages.
EuroFibers, Dyneema® Reference, On or before Dec. 31, 2003 in year 2003, [retrieved on Jun. 5, 2014]. Retrieved from the Internet: <http://eurofibers.com/en/fibers/dyneema >, 5 pages.

(Continued)

*Primary Examiner* — Alexander Niconovich
(74) *Attorney, Agent, or Firm* — Barclay Damon, LLP

(57) ABSTRACT

A bowstring including first and second ultra high molecular weight polyolefin fibers is described herein. The first and second ultra high molecular weight polyolefin fibers have different compositions such that the first ultra high molecular weight polyolefin fibers have a greater elasticity than the second ultra high molecular weight polyolefin fibers.

24 Claims, 2 Drawing Sheets

(56) References Cited

U.S. PATENT DOCUMENTS

| | | | | |
|---|---|---|---|---|
| 6,381,940 | B1 * | 5/2002 | Kolmes | D02G 3/442 57/210 |
| 6,651,643 | B2 * | 11/2003 | Simonds | F41B 5/14 124/90 |
| 7,182,079 | B2 * | 2/2007 | McPherson | F41B 5/14 124/90 |
| 7,231,915 | B2 * | 6/2007 | McPherson | F41B 5/14 124/90 |
| 7,434,574 | B2 * | 10/2008 | McPherson | F41B 5/14 124/90 |
| 2003/0079732 | A1 * | 5/2003 | Simonds | F41B 5/14 124/90 |
| 2012/0152219 | A1 * | 6/2012 | McPherson | F41B 5/1411 124/25 |
| 2014/0252058 | A1 * | 9/2014 | Jones | F41B 5/10 224/576 |
| 2014/0261366 | A1 * | 9/2014 | McPherson | D02G 3/444 124/90 |

OTHER PUBLICATIONS

Vectran™ Liquid Crystal Technology Reference, On or before Dec. 31, 2006 in year 2006, Kuraray America, Inc., 27 pages.

Vectran® Liquid Crystal Polymer Fiber Reference, On or before Dec. 31, 1999 in year 1999, Celanese Acetate LLC, 24 pages.

Honeywell Spectra® Fiber Reference, On or before Dec. 31, 2013 in year 2013, Honeywell International Inc., [retrieved on Jun. 6, 2015]. Retrieved from the Internet: <http://www.honeywell-advancedfibersandcomposites.com/products/fibers/>, 2 pages.

Dyneema® Fact Sheet, Jan. 1, 2008, DSM Dyneema LLC, 2 pages.

"Technical brochure: Dyneema® in marine and industrial applications", On or before Jul. 24, 2014, DSM Dyneema LLC, 8 pages.

"Marlowe®,The Definitive Rope Guide", On or before Jul. 24, 2014, Marlowe Ropes, Inc., 29 pages.

"BCY Fibers—Frequently Asked Questions", On or before Jul. 23, 2014, BCY Bowstring, [retrieved on Jul. 23, 2014]. Retrieved from the Internet: http://www.bcyfibers.com/FAQs.php, 5 pages.

* cited by examiner

BOWSTRING HAVING DIFFERENT ULTRA HIGH MOLECULAR WEIGHT POLYETHYLENE FIBERS FOR CREEP REDUCTION

CROSS-REFERENCE TO RELATED APPLICATION

This application is a non-provisional of, and claims the benefit and priority of, U.S. Provisional Patent Application No. 62/028,885, filed on Jul. 25, 2014. The entire contents of such application are hereby incorporated by reference.

BACKGROUND

Bowstrings serve an important role in the shooting of a bow. Sometimes, bowstrings break before their life expectancy. Other times, bowstrings lose elasticity, resulting in a slack that hinders shooting performance. Fibers for use in strands of bowstrings of bows and crossbows experience challenges that are not experienced by fibers in other fields. For example, a bowstring may be formed through a manufacturing tensioning process. In the manufacturing tensioning process, the manufacturer tensions a plurality of individual strands, each strand including a plurality of fibers, to a predetermined manufacturing tension (e.g. 600 lbs of force). While under the predetermined manufacturing tension, the plurality of individual strands may then be twisted at a predetermined pitch (e.g. one twist for every 1.25 inches of length). Servings, such as wax and/or dye, may be applied while under the predetermined manufacturing tension. As a result of tensioning the strands at the pre-determined manufacturing tension during the twisting process, the individual strands settle or set into a twisted state. This setting or settling helps to prevent the bowstring from creeping and elongating after the manufacturing tensioning process, such as during use of the bowstring in a bow.

A number of materials are used in the formation of bowstrings, such asultra high molecular weight polyolefins. Ultra high molecular weight polyolefins are polyolefins that have a molecular weight greater than about one million and often between three million and six million. Examples of ultra high molecular weight polyolefin fibers include the fibers sold under the tradenames SPECTRA® and DYNEEMA®. Bowstrings formed from SPECTRA® 1000 experience undesirable creep (the tendency to stretch under tension without return when the tension is removed, resulting in slack) when tensioned in a bow or crossbow. Undesirable creep can occur during use of the bowstring. For example, the bowstring may have an initial length when under an initial installation tension as installed on a bow. When the archer draws back the bowstring, applying a drawback tension, the bowstring stretches to a drawback length that is much greater than the initial length. When the archer releases the bowstring and the drawback tension, the bowstring shortens to a return length. Due to creep, the return length can be substantially greater than the initial length, resulting in undesirable slack in the bowstring. This slack can hinder shooting performance and accuracy.

Bowstrings formed from DYNEEMA® experience high elasticity (the tendency to stretch under tension and then return when the tension is removed), but the return action can be counterproductive to the manufacturing tensioning and setting process described above. Bowstrings with high elasticity have been found to be unsuitable with the manufacturing tensioning and setting process described above—the bowstrings return to their original states too readily, and the setting process fails during or upon completion of the manufacturing tensioning process. Issues such as elasticity and elongation are particularly pertinent to bowstrings that have servings applied while the bowstring was under the predetermined tension. In these bowstrings, servings tend to separate or deteriorate when the bowstrings elongate after returning to their original states. For example, lower grade DYNEEMA® will elongate through the pre-stretching manufacturing process, but may also be subject to future elongation and does not have the same feel and stability of the material with the higher grade DYNEEMA®. When higher grade DYNEEMA® is used, the elasticity levels are greater (creating stability and superior feel) but, due to this elasticity, the pre-stretching manufacturing process causes the bowstring to take a temporary set, resulting in a finite amount of "return." For example, a bowstring may be pre-tensioned to have a finished length of fifty-eight inches after finishing (hot length). This is a standard measurement used in the archery industry where the measurement is taken at 100 lbs of tension measure on one-quarter dowel pins. Once this bowstring has sat for several hours, the finished length may decrease and return anywhere from one-quarter to one-eighth inch due to the elasticity. Combining DYNEEMA® with VECTRAN® can still result in an undesirable decrease and return of one-sixteenth to one-eighth inch of change.

Materials used in the formation of bowstrings also include liquid crystal polymer fibers. Examples of liquid crystal polymer fibers include the fibers sold under the tradename VECTRAN®. Bowstrings formed from VECTRAN® are prone to break during use. Such bowstrings are also unsuitable with the manufacturing tensioning and setting process described above. The servings of such bowstrings tend to separate or deteriorate after the bowstrings return to their original states.

Some bowstrings have been formed from a blend of ultra high molecular weight polyolefin fibers and liquid crystal polymer fibers (e.g. 10-30% liquid crystal polymer fibers and 70-90% ultra high molecular weight polyolefin fibers). While bowstrings formed from such a blend experience improved creep and reduced tendency to break, they have still been found to be unsuitable for use with the manufacturing tensioning and setting process described above. The servings of such bowstrings tend to separate or deteriorate after the bowstrings return to their original states.

Materials used in the formation of bowstrings also include blends of ultra high molecular weight polyolefin fibers and stretched polytetrafluoroethylene fibers. Examples of stretched polytetrafluoroethylene fibers include the fibers sold under the tradename GORE-TEX®. While bowstrings formed from such a blend experience improved creep and reduced tendency to break, they have still been found to be unsuitable for use with the manufacturing tensioning and setting process described above. The servings of such bowstrings tend to separate or deteriorate after the bowstrings return to their original states.

The foregoing background describes some, but not necessarily all, of the problems, disadvantages and shortcomings related to compositions, structures, and manufacture of bowstrings.

SUMMARY

The bowstring and method disclosed herein combine two grades of High Molecular Weight Polyethylene (HMWPE), one with higher elasticity and one with lower elasticity to reduce the shooting return or creep to zero or substantially zero, while maintaining a suitable level of overall elasticity during the manufacturing setting process. In an embodiment, the bowstring includes first and second ultra high molecular weight polyolefin fibers. The first and second ultra high molecular weight polyolefin fibers have different compositions such that the first ultra high molecular weight polyolefin fibers have a greater elasticity than the second ultra high molecular weight polyolefin fibers.

A gigapascal (GPa) is a decimal multiple of the pascal, which is the unit of pressure derived from the International System of Units (SI), a measurement of stress, Young's modulus and tensile strength. The GPa can measure or indicate the tensile strength of the bowstring, a strand of the bowstring, or a fiber of a strand of the bowstring. Therefore, there is a relationship or association between the GPa of each fiber and the elasticity of each fiber.

Within a unit, such as a strand, of the bowstring, the different types of fibers can have different mass percentages. For example, a strand can include fiber types A and B, where fiber type A has GPa A and elasticity A, and fiber type B has GPa B and elasticity B. In such strand, fiber type A may have a mass percentage or mass per mass (m/m) of 40%, and fiber type B may have a mass percentage or mass per mass (m/m) of 60%.

In an embodiment, a bowstring includes a first ultra high molecular weight polyolefin fiber having a first elasticity and a second ultra high molecular weight polyolefin fiber in contact with the first ultra high molecular weight polyolefin. The second ultra high molecular weight polyolefin has a second elasticity that is greater than the first elasticity. A serving material is applied to the first and second ultra high molecular weight polyolefin fibers when the first and second ultra high molecular weight polyolefin fibers are under a manufacturing tension so as to set the bowstring. The first and second high molecular weight polyolefin fibers cooperate to reduce a loss in bowstring elasticity so as to reduce bowstring creep during use of the bowstring. The first and second ultra high molecular weight polyolefin fibers are chemically configured or structured to facilitate the setting of the bowstring.

In another embodiment, a bowstring includes a plurality of strands twisted together to form the bowstring. Each one of the strands includes a plurality of first ultra high molecular weight polyethylene fibers and a plurality of second ultra high molecular weight polyethylene fibers. Each of the plurality of first ultra high molecular weight polyethylene fibers has a first elasticity that is greater than a second elasticity of each of the plurality of second ultra high molecular weight polyethylene fibers.

In yet another embodiment, a bowstring produced through a method is described. The method includes forming a plurality of first ultra high molecular weight polyolefin fibers and forming a plurality of second ultra high molecular weight polyolefin fibers. Each one of the plurality of first ultra high molecular weight polyolefin fibers has a first elasticity that is greater than a second elasticity of each one of the plurality of second ultra high molecular weight polyolefin fibers. The method further includes combining a plurality of the first ultra high molecular weight polyolefin fibers with a plurality of the second ultra high molecular weight polyolefm fibers to form a first strand and combining a plurality of the first ultra high molecular weight polyolefin fibers with a plurality of the second ultra high molecular weight polyolefin fibers to form a second strand. Further, the method includes tensioning the first and second strands to a predetermined tension to produce pre-tensioned strands and twisting the pre-tensioned strands together at a predetermined pitch to produce a pre-tensioned, twisted strand assembly. In addition, the method includes applying one or more servings to the twisted strand assembly and releasing the predetermined tension.

Additional features and advantages of the present disclosure are described in, and will be apparent from, the following Brief Description of the Drawings and Detailed Description.

DETAILED DESCRIPTION

Figure 1:
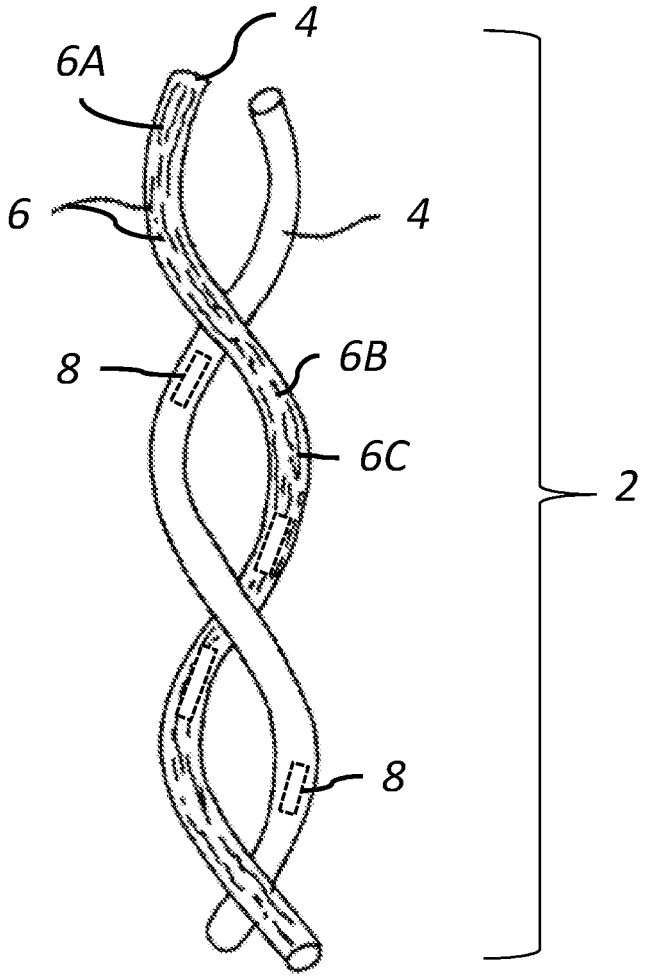
FIG. 1 is fragmentary, isometric view of an embodiment of the bowstring.
Figure 2:
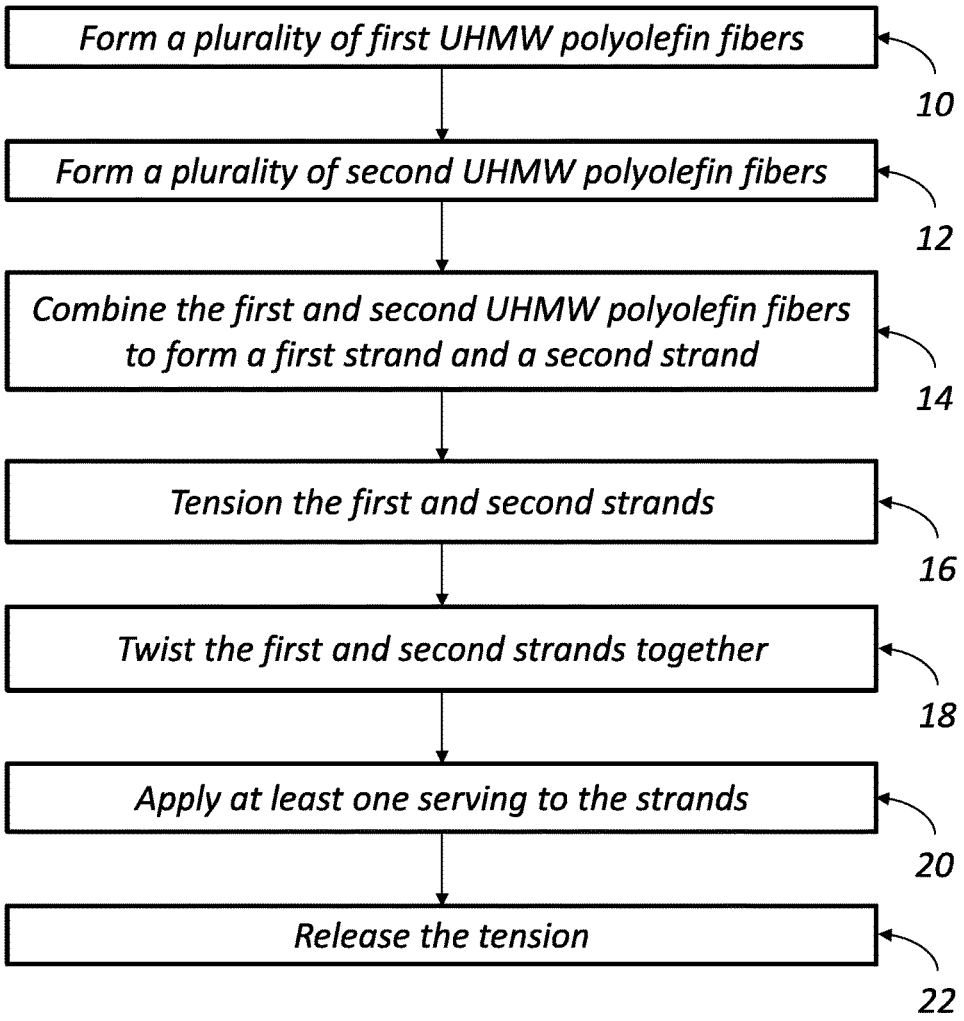
FIG. 2 is a flow diagram illustrating a method of manufacturing a bowstring.

FIG. 1 illustrates a segment or section of a bowstring 2. The bowstring 2 includes at least two strands 4 of material. As illustrated, the strands 4 can be twisted or braided together to form the bowstring 2. Each strand 4 includes a plurality of fibers 6. The fibers 6 can be twisted or otherwise coupled, combined, or manipulated to bring the fibers 6 in contact with each other in order to form each strand 4. In an embodiment, each strand 4 includes at least a first 6A and second 6B ultra high molecular weight polyolefin fibers having different compositions. In another embodiment, each strand 4 includes at least a first 6A, second 6B, and third 6C ultra high molecular weight polyolefin fibers having different compositions. For example, each strand 4 can include at least a plurality of the first ultra high molecular weight polyolefin fibers and a plurality of the second ultras high molecular weight polyolefin fibers. The fibers 6 are chemically structured to provide a relatively strong bowstring with a suitable tensile strength, suitable elasticity and high creep resistance.

The first and second ultra high molecular weight polyolefin fibers have different chemical structures or compositions such that the first ultra high molecular weight polyolefin fibers have a greater elasticity than the second ultra high molecular weight polyolefin fibers. Ultra high molecular weight polyolefin fibers with different elasticity values are commercial available. For example, DYNEEMA® is commercially available in different grades (e.g. DYNEEMA® SK75, DYNEEMA® SK90, etc.) each of which has a different modulus of elasticity.

With reference to FIG. 4, in an embodiment, the bowstring 2 can be produced by forming 10 a plurality of first ultra high molecular weight polyolefin fibers 6A and forming 12 a plurality of second ultra high molecular weight polyolefin fibers 6B. Following formation of the first and second UHMW fibers, the first and second UHMW fibers can be combined 14 to form a first strand and the first and second UHMW fibers can be combined 16 to form a second strand. In an embodiment, following formation of the first and second strands, the bowstring 2 is produced or manufactured according to the manufacturing steps of: (a) placing 16 the bowstring under a designated amount of manufacturing tension for a designated period of time; (b) twisting 18 the first and second strands together; (c) during the period, applying 20 one or more serving materials 8 to the bowstring to set or cure the bowstring; and releasing 22 the tension. In another embodiment, the bowstring 2 is produced or manufactured according to the manufacturing steps of: (a) applying one or more serving materials 8 to the bowstring to set or cure the bowstring; and (b) then placing the bowstring under a designated amount of manufacturing tension for a designated period of time. The tensioning step converts the bowstring 2 (including its strands 4 and fibers 6) to a manufacturing stretched state. At the end of the tensioning step, when the manufacturing tension is released and the bowstring 2 is in a tension-free state, the bowstring 2 has an initial length. Afterwards, the bow manufacturer installs the bowstring 2 in a bow under a designated installation tension associated with an initial or installation length. During use of the bow, the archer draws the bowstring 2 backward under a draw-back tension, stretching the bowstring to a drawback length. When the archer releases the bowstring 2, the bowstring 2 elastically compresses to a return length. The initial or installation length and the final or return length are each less than the drawback length. The fiber structure or composition described above reduces or eliminates undesirable creep or elongation of the bowstring 2 following application and release of a tension, such as a draw-back tension. As a result, the final or return length is the same as, or substantially the same as, the initial or installation length. Depending upon the embodiment, the curing or serving material 8 can include, in liquid or solid form, a wax, adhesive, resin, dye, paint, polymer, or other solution configured to enhance the integrity and lifespan of the bowstring. The end-loop serving materials 8 tightly grip the underlying string strands 4 to prevent separations, loosening, and fraying. The center serving material 8 provides for a smooth and consistent release from the shooting tab surface, and the center serving material 8 also resists separation and loosening of the strands 4, and it also resists wear from brushing against the archer's armguard after the shot. Also, the center serving material 8 maintains or retains the constant diameter of the bowstring 2 over a relatively long period of time.

In one embodiment, the chemically blended structure of the bowstring further comprises a stretched polytetrafluoroethylene fiber, that is, a polytetrafluoroethylene fiber which has been stretched through the manufacturing tension process. One such bowstring blend is shown in Table 1, wherein a 1545 denier bowstring is provided that consists essentially of DYNEEMA® SK90, SPECTRA® 1000 and GORE-TEX®.

TABLE 1

| Material | Denier | % | Modulus (GPa) |
|---|---|---|---|
| DYNEEMA ® SK90 | 945 | 61% | ~140 |
| SPECTRA ® 1000 | 400 | 26% | ~100-115 |
| GORE-TEX ® | 200 | 13% | N/A |
| Total | 1545 | 100% | |

In another embodiment, a bowstring has a structure based on a chemically blended composition of first, second and third ultra high molecular weight polyolefin fibers. The first and second ultra high molecular weight polyolefin fibers have different compositions such that the first ultra high molecular weight polyolefin fibers have a greater elasticity than the second ultra high molecular weight polyolefin fibers. The third ultra high molecular weight polyolefin fibers are different from the first and second ultra high molecular weight polyolefin fibers in that they have an elasticity that is less than the elasticity of both the first and the second ultra high molecular weight polyolefin fibers. One such bowstring blend is shown in Table 2, wherein a 1345 denier bowstring is provided that consists essentially of DYNEEMA® SK90, DYNEEMA® SK75 and SPECTRA® 1000. In one embodiment, the bowstring further comprises a stretched polytetrafluoroethylene fiber.

TABLE 2

| Material | Denier | % | Modulus (GPa) |
|---|---|---|---|
| DYNEEMA ® SK90 | 945 | 70% | ~140 |
| DYNEEMA ® SK75 | 200 | 15% | ~109-132 |
| SPECTRA ® 1000 | 200 | 15% | ~100-115 |
| Total | 1345 | 100% | |

In another embodiment, a bowstring has a structure based on a chemically blended composition comprising first, second and third ultra high molecular weight polyolefin fibers in combination with liquid crystal polymer fibers and stretched polytetrafluoroethylene fibers. The first and second ultra high molecular weight polyolefin fibers have different compositions such that the first ultra high molecular weight polyolefin fibers have a greater elasticity than the second ultra high molecular weight polyolefin fibers. The third ultra high molecular weight polyolefin fibers are different from the first and second ultra high molecular weight polyolefin fibers in that they have an elasticity that is less than the elasticity of both the first and the second ultra high molecular weight polyolefin fibers. One such bowstring blend is shown in Table 7, wherein a 1300 denier bowstring is provided that consists essentially of DYNEEMA® SK90, DYNEEMA® SK75, SPECTRA® 1000, VECTRAN® and GORE-TEX®. In the embodiment of Table 3, the ultra high molecular weight polyolefin fibers and the liquid crystal polymer fibers of a unit of the bowstring are present in equal proportions. The unit has a total weight. The stretched polytetrafluoroethylene fibers provide the balance of the total weight less the weight of the ultra high molecular weight polyolefin fibers and the liquid crystal polymer fibers.

TABLE 3

| Material | Denier | % | Modulus (GPa) |
|---|---|---|---|
| DYNEEMA ® SK90 | 300 | 23% | ~140 |
| DYNEEMA ® SK75 | 300 | 23% | ~109-132 |
| SPECTRA ® 1000 | 300 | 23% | ~100-115 |
| VECTRAN ® | 300 | 23% | ~75 |
| GORE-TEX ® | 100 | 8% | N/A |
| Total | 1300 | 100% | |

In another embodiment, a bowstring has a structure based on a chemically blended composition comprising first and second ultra high molecular weight polyolefin fibers in combination with a liquid crystal polymer fiber is provided. The first and second ultra high molecular weight polyolefin fibers have different compositions such that the first ultra high molecular weight polyolefin fibers have a greater elasticity than the second ultra high molecular weight polyolefin fibers. One such bowstring blend is shown in Table 4, wherein a 1345 denier bowstring is provided that consists essentially of DYNEEMA® SK90, DYNEEMA® SK75 and VECTRAN®. Another such bowstring blend is shown in Table 5, wherein a 1345 denier bowstring is provided that consists essentially of DYNEEMA® SK90, SPECTRA® 1000 and VECTRAN®.

TABLE 4

| Material | Denier | % | Modulus (GPa) |
|---|---|---|---|
| DYNEEMA ® SK90 | 945 | 70% | ~140 |
| DYNEEMA ® SK75 | 200 | 15% | ~109-132 |
| VECTRAN ® | 200 | 15% | ~75 |
| Total | 1345 | 100% | |

TABLE 5

| Material | Denier | % | Modulus (GPa) |
|---|---|---|---|
| DYNEEMA ® SK90 | 945 | 70% | ~140 |
| SPECTRA ® 1000 | 200 | 15% | ~100-115 |
| VECTRAN ® | 200 | 15% | ~75 |
| Total | 1345 | 100% | |

In another embodiment, a bowstring has a structure based on a chemically blended composition comprising first and second ultra high molecular weight polyolefin fibers in combination with a liquid crystal polymer fiber and stretched polytetrafluoroethylene fibers is provided. The first and second ultra high molecular weight polyolefin fibers have different compositions such that the first ultra high molecular weight polyolefin fibers have a greater elasticity than the second ultra high molecular weight polyolefin fibers. One such bowstring blend is shown in Table 6, wherein a 1300 denier bowstring is provided that consists essentially of DYNEEMA® SK90, SPECTRA® 1000, VECTRAN® and GORE-TEX®. A similar bowstring blend is shown in Table 7 wherein a 1200 denier bowstring is provided.

TABLE 6

| Material | Denier | % | Modulus (GPa) |
|---|---|---|---|
| DYNEEMA ® SK75 | 400 | 31% | ~109-132 |
| SPECTRA ® 1000 | 400 | 31% | ~100-115 |
| VECTRAN ® | 300 | 23% | ~75 |
| GORE-TEX ® | 200 | 15% | N/A |
| Total | 1300 | 100% | |

TABLE 7

| Material | Denier | % | Modulus (GPa) |
|---|---|---|---|
| DYNEEMA ® SK75 | 400 | 33% | ~109-132 |
| SPECTRA ® 1000 | 400 | 33% | ~100-115 |
| VECTRAN ® | 200 | 17% | ~75 |
| GORE-TEX ® | 200 | 17% | N/A |
| Total | 1200 | 100% | |

In some embodiments, the first ultra high molecular weight polyethylene fiber is structured or configured to have an elasticity that is at least 5 GPa greater than the elasticity of the second ultra high molecular weight polyethylene fiber. In some embodiments the difference is at least 10 GPa. The first ultra high molecular weight polyethylene fiber may be selected to have an elasticity that is greater than 135 GPa (e.g. between about 135 GPa and 145 GPa). The second ultra high molecular weight polyethylene fiber may be selected to have an elasticity that is less than 135 GPa (e.g. between about 100 GPa and about 135 GPa). In another embodiment, the second ultra high molecular weight polyethylene fiber may be selected to have an elasticity that is less than 120 GPa (e.g. between about 100 GPa and about 120 GPa). In those embodiments where a third ultra high molecular weight polyethylene fiber is present, the elasticity of the third ultra high molecular weight polyethylene fiber is, in some embodiments, at least 5 GPa different than the elasticity of both the first and second ultra high molecular weight polyethylene fibers. The liquid crystal polymer fiber may be selected to have an elasticity between 50 GPa and 90 GPa. In one embodiment, the bowstring is twisted (e.g. unbraided).

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A bowstring comprising:

a first ultra high molecular weight polyolefin fiber comprising a first elasticity associated with a manufacturing contraction reduction characteristic;

a second ultra high molecular weight polyolefin fiber in contact with the first ultra high molecular weight polyolefin, the second ultra high molecular weight polyolefin comprising a second elasticity associated with an operational contraction enhancement characteristic, wherein the second elasticity is at least 5 percent greater than the first elasticity; and a serving material applied to the first and second ultra high molecular weight polyolefin fibers when the first and second ultra high molecular weight polyolefin fibers are under a manufacturing tension so as to set the bowstring, wherein, when the first and second ultra high molecular weight polyolefin fibers are under the manufacturing tension, a segment of the bowstring comprises an initial length, wherein, when the manufacturing tension is removed and the bowstring is set, the segment comprises a return length, wherein the return length differs from the initial length by less than 0.10 percent as a result of the manufacturing contraction reduction characteristic, wherein, when the bowstring is set, installed on a bow and subject to an operational tension, the second ultra high molecular weight polyolefin fiber is configured to decrease an accumulation of slack in the bowstring, wherein the decrease in the accumulation of slack is a result of the operational contraction enhancement characteristic.

2. The bowstring of claim 1, wherein the first elasticity and the second elasticity differ by at least 10 GPa.

3. The bowstring of claim 1, further comprising a stretched polytetrafluoroethylene fiber.

4. The bowstring of claim 1, further comprising a third ultra high molecular weight polyolefin fiber comprising a third elasticity, the third elasticity being at least 5 GPa different than each the first elasticity and the second elasticity.

5. The bowstring of claim 4, further comprising a liquid crystal polymer fiber.

6. The bowstring of claim 5, further comprising a stretched polytetrafluoroethylene fiber.

7. The bowstring of claim 1, further comprising a liquid crystal polymer fiber and a stretched polytetrafluoroethylene fiber.

8. The bowstring of claim 7, further comprising a plurality of strands twisted about each other, at least one of the strands comprising the first ultra high molecular weight polyolefin fiber and the second ultra high molecular weight polyolefin fiber.

9. The bowstring of claim 1, wherein the second elasticity is greater than 135 GPa and the first elasticity is less than 135 GPa, and the first elasticity and the second elasticity differ by at least 10 GPa.

10. The bowstring of claim 1, wherein the second elasticity is at least 10 percent greater than the first elasticity.

11. The bowstring of claim 1, wherein the second elasticity is at least 15 percent or 20 percent greater than the first elasticity.

12. The bowstring of claim 1, wherein the return length is identical to the initial length.

13. A bowstring comprising:

a plurality of strands twisted together to form the bowstring, each one of the strands comprising:

a plurality of first ultra high molecular weight polyethylene fibers; and a plurality of second ultra high molecular weight polyethylene fibers, wherein each of the plurality of first ultra high molecular weight polyethylene fibers has a first elasticity that is at least 5 percent greater than a second elasticity of each of the plurality of second ultra high molecular weight polyethylene fibers.

14. The bowstring of claim 13, wherein the first elasticity is between about 135 and 145 GPa and the second elasticity is between about 100 GPa and 135 GPa, and the first elasticity and the second elasticity differ by at least 5 GPa.

15. The bowstring of claim 14, wherein at least one of the strands comprises a stretched polytetrafluoroethylene fiber.

16. The bowstring of claim 15, wherein the plurality of first ultra high molecular weight polyethylene fibers is 61±3% m/m of the twisted strands, the plurality of second first ultra high molecular weight polyethylene fibers is 26±3% m/m of the twisted strands, and the stretched polytetrafluoroethylene fiber is 13±3% m/m of the twisted strands.

17. The bowstring of claim 13, further comprising a plurality of third ultra high molecular weight polyethylene fibers, each having a third elasticity, the third elasticity being at least 5 GPa different than each of the first elasticity and the second elasticity.

18. The bowstring of claim 17, wherein at least one of the first ultra high molecular weight polyethylene fibers is 70±3% m/m of the twisted strands, at least one of the second ultra high molecular weight polyethylene fibers is 15±3% m/m of the twisted strands and at least one of the third ultra high molecular weight polyethylene fibers is 15±3% m/m of the twisted strands.

19. The bowstring of claim 17, further comprising:

a plurality of liquid crystal polymer fibers; and a plurality of stretched polytetrafluoroethylene fibers.

20. The bowstring of claim 19, wherein:

the first ultra high molecular weight polyethylene fibers, the second ultra high molecular weight polyethylene fibers, the third ultra high molecular weight polyethylene fibers, and the plurality of liquid crystal polymer fibers are each present in equal proportions by mass of one unit of one of the strands within ±3%;

the unit has a total weight; and the plurality of stretched polytetrafluoroethylene fibers provide a balance of the total weight less an aggregate weight of the first ultra high molecular weight polyethylene fibers, the second first ultra high molecular weight polyethylene fibers, the third ultra high molecular weight polyethylene fibers, and the plurality of liquid crystal polymer fibers.

21. The bowstring of claim 19, wherein each of the first ultra high molecular weight polyethylene fibers is 31±3% m/m of the strands, each of the second ultra high molecular weight polyethylene fibers is 31±3% m/m m/m of one of the strands, each of the plurality of liquid crystal polymer fibers is 23±3% m/m of one of the strands and each of the stretched polytetrafluoroethylene fibers is 15±3% m/m of one of the strands.

22. The bowstring of claim 19, wherein each of the first ultra high molecular weight polyethylene fibers is 33±3% m/m of one of the strands, each of the second ultra high molecular weight polyethylene fibers is 33±3% m/m of one of the strands, the plurality of liquid crystal polymer fibers is 17±3% m/m of one of the strands, and the plurality of stretched polytetrafluoroethylene fibers is 17±3% m/m of one of the strands.

23. A bowstring produced through a method, the method comprising:

forming a plurality of first ultra high molecular weight polyolefin fibers;

forming a plurality of second ultra high molecular weight polyolefin fibers, wherein each one of the plurality of first ultra high molecular weight polyolefin fibers has a first elasticity associated with a contraction reduction effect, wherein each one of the plurality of second ultra high molecular weight polyolefin fibers has a second elasticity associated with a contraction enhancement effect, wherein the second elasticity is greater by at least 5 percent than the first elasticity;

combining a plurality of the first ultra high molecular weight polyolefin fibers with a plurality of the second ultra high molecular weight polyolefin fibers to form a first strand;

combining a plurality of the first ultra high molecular weight polyolefin fibers with a plurality of the second ultra high molecular weight polyolefin fibers to form a second strand;

tensioning the first and second strands to a predetermined tension to produce pre-tensioned strands;

twisting the pre-tensioned strands together at a predetermined pitch to produce a pre-tensioned, twisted strand assembly having an initial length;

applying one or more servings to the first and second strands before or after the tensioning step; and releasing the predetermined tension, wherein after the predetermined tension is released, the contraction reduction effect prevents the twisted strand assembly from having a return length that differs from the initial length by over 0.10 percent.

24. The bowstring of claim 23, wherein:

as a result of the contraction reduction effect, the twisted strand assembly is operable to reduce creep in the bowstring after the predetermined tension is released; and as a result of the contraction enhancement effect, the twisted strand assembly is operable to decrease an accumulation of slack in the bowstring when the bowstring is installed on a bow and repeatedly retracted and released in use.

* * * * *